US008104285B2

(12) United States Patent
Bonzani et al.

(10) Patent No.: US 8,104,285 B2
(45) Date of Patent: Jan. 31, 2012

(54) GAS TURBINE EQUIPPED WITH A GAS BURNER AND AXIAL SWIRLER FOR THE BURNER

(75) Inventors: Federico Bonzani, Genoa (IT); Paolo Gobbo, Genoa (IT)

(73) Assignee: Ansaldo Energia S.p.A., Genoa (IT)

( * ) Notice: Subject to any disclaimer, the term of this patent is extended or adjusted under 35 U.S.C. 154(b) by 746 days.

(21) Appl. No.: 12/088,708

(22) PCT Filed: Sep. 30, 2005

(86) PCT No.: PCT/IT2005/000569

§ 371 (c)(1),
(2), (4) Date: Oct. 2, 2008

(87) PCT Pub. No.: WO2007/036964

PCT Pub. Date: Apr. 5, 2007

(65) Prior Publication Data

US 2009/0025394 A1 Jan. 29, 2009

(51) Int. Cl.

| | |
|---|---|
| ***F02C 1/00*** | (2006.01) |
| ***F02G 3/00*** | (2006.01) |
| ***B05B 7/10*** | (2006.01) |

(52) U.S. Cl. ..... 60/748; 239/399

(58) Field of Classification Search ..... 60/748, 60/39.828, 39.821, 39.827; 239/399, 400, 239/403, 404, 405, 406; 431/9, 182, 183
See application file for complete search history.

(56) References Cited

U.S. PATENT DOCUMENTS

| | | | | |
|---|---|---|---|---|
| 4,701,124 | A | 10/1987 | Maghon et al. | |
| 5,451,160 | A | 9/1995 | Becker | |
| 6,148,603 | A | 11/2000 | Althaus | |
| 6,532,726 | B2 * | 3/2003 | Norster et al. | 60/39.281 |
| 2002/0174656 | A1 * | 11/2002 | Hein | 60/737 |
| 2004/0172951 | A1 | 9/2004 | Hannemann et al. | |
| 2006/0266046 | A1 | 11/2006 | Bonzani et al. | |

FOREIGN PATENT DOCUMENTS

| | | |
|---|---|---|
| EP | 1659339 | 5/2006 |
| WO | 2005/010438 | 2/2005 |

OTHER PUBLICATIONS

Maghon et al., "Progress Maghon et al., in NOx and CO Emission Reduction of Gas Turbines", American Society of Mechanical Engineers Symposia series, New York, NY, US, Oct. 21, 1990, pp. 1-7.

* cited by examiner

*Primary Examiner* — Ehud Gartenberg
*Assistant Examiner* — Nicholas Karnezos
(74) *Attorney, Agent, or Firm* — Greenblum & Bernstein, P.L.C.

(57) ABSTRACT

A gas turbine equipped with a burner, which has an axial swirler for generating turbulence in a flow of comburent air, a secondary supply line of fuel gas, a main supply line of fuel gas arranged concentrically around the secondary line, and a pilot line of fuel gas. Accordingly, the burner is ignited by firing a spark and feeding, towards the spark, comburent air and fuel gas which is synthesis gas.

6 Claims, 6 Drawing Sheets

GAS TURBINE EQUIPPED WITH A GAS BURNER AND AXIAL SWIRLER FOR THE BURNER

TECHNICAL FIELD

The present invention relates to a method for starting a gas turbine equipped with a gas burner.

BACKGROUND ART

So as to produce electrical power, it is known to use electric machines powered by gas turbines comprising a burner assembly which is ignited and started using a natural gas as fuel and then, when the electric machine has exceeded a predetermined value of load, is fed by a so called synthesis gas or syngas, that is a fuel gas rich in hydrogen and having a relatively low calorific value (low-BTU), for example a fifth of the calorific value of natural gas.

However, the use of the two different types of fuel gas for starting the burner assembly of the turbine is unsatisfactory, since it is necessary to envisage double connecting systems to deliver fuel gas from different sources, and it is necessary to bear a relatively high fixed cost for the natural gas supply contract, while the number of times the burner assembly is ignited is in effect relatively low.

DISCLOSURE OF INVENTION

The object of the present invention is to provide a method for starting a gas turbine equipped with a gas burner, which allows to resolve in a simple and economic manner the above-mentioned problems and which, preferably, can be carried out without flashback and localised overheating of the burner, and which can be also implemented in existing burners with only slight structural modifications.

According to the present invention a method is provided for starting a gas turbine equipped with a gas burner comprising:

- an axial swirler to generate turbulence in a flow of comburent air,
- a secondary fuel gas supply line,
- a main fuel gas supply line arranged concentrically around said secondary line, and
- a fuel gas supply pilot line;

the method comprising the step of igniting said burner causing a spark and feeding comburent air and fuel gas towards said spark; characterised in that the fuel gas fed towards said spark is synthesis gas.

The present invention also relates to an axial swirler for a burner on a gas turbine.

BRIEF DESCRIPTION OF THE DRAWINGS

The invention will now be described with reference to the accompanying drawings, which illustrate a non-limitative exemplary embodiment, in which:

FIGS. 3 and 4 are two different perspective views showing details of the burner in FIG. 1.

FIGS. 3 and 4A are two different perspective views showing details of the burner in FIG. 1;

BEST MODE FOR CARRYING OUT THE INVENTION

Figure 1:
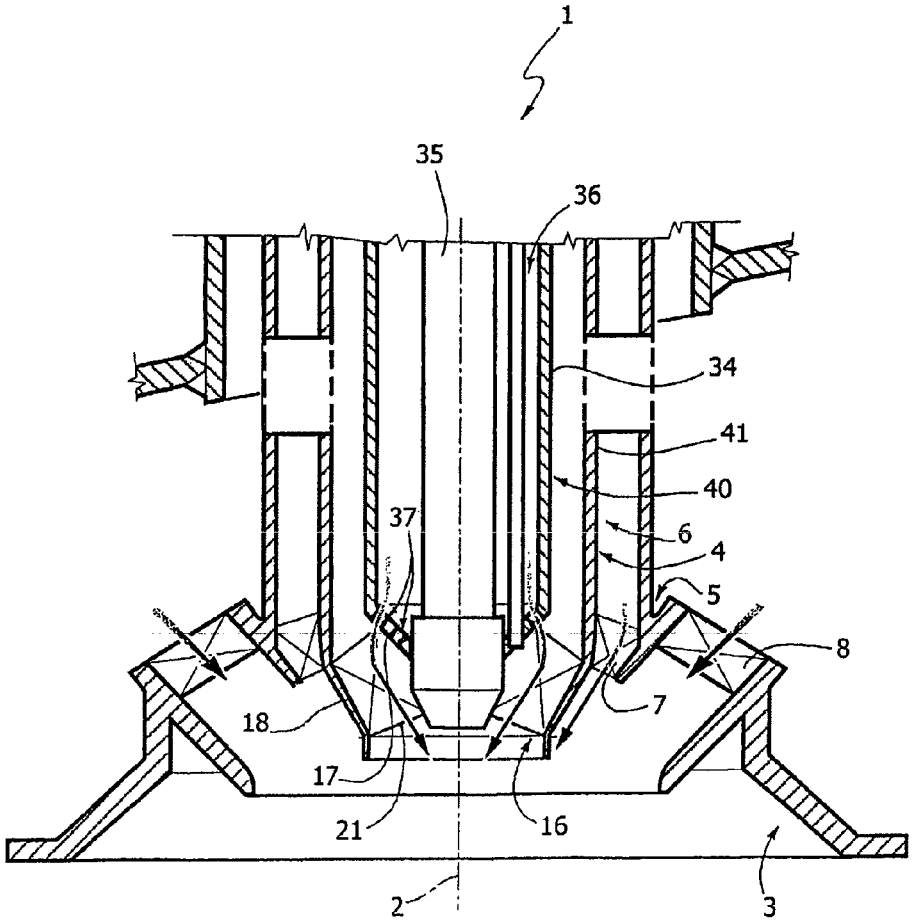
FIG. 1 is a schematic cross-section of a gas burner to carry out the method of the present invention.

In FIG. 1, it is indicated by 1 a burner assembly, which is feeded with fuel gas and forms part of a gas turbine (not illustrated) which, in use, drags in rotation a shaft of an electric machine (not illustrated) to produce electrical power.

The assembly 1 extends along an axis 2, generates, in use, combustion in a chamber 3 (partially illustrated) and comprises a central burner 4 and a peripheral burner 5 coaxial to and arranged around the burner 4.

The burner 5 comprises a main supply line 6 for fuel gas, known as "the main diffusion line", which comes out into the chamber 3, through an outlet 7 concentric and external with respect to the burner 4 and supplies synthesis fuel gas, or syngas, to generate a diffusion flame with a flow of comburent air.

The comburent air comprises primary air for combustion coming from burner 4 and secondary air for combustion coming from a bladed device 8, generally known as a swirler, which is arranged around the outlet 7 and generates turbulence in the flow of air which has been flown into the chamber 3 with a so-called "diagonal" mean path.

Similarly, the burner 4 comprises its own bladed device known as axial swirler, indicated by reference numeral 16, to generate turbulence in the flow of primary air.

Figure 2:
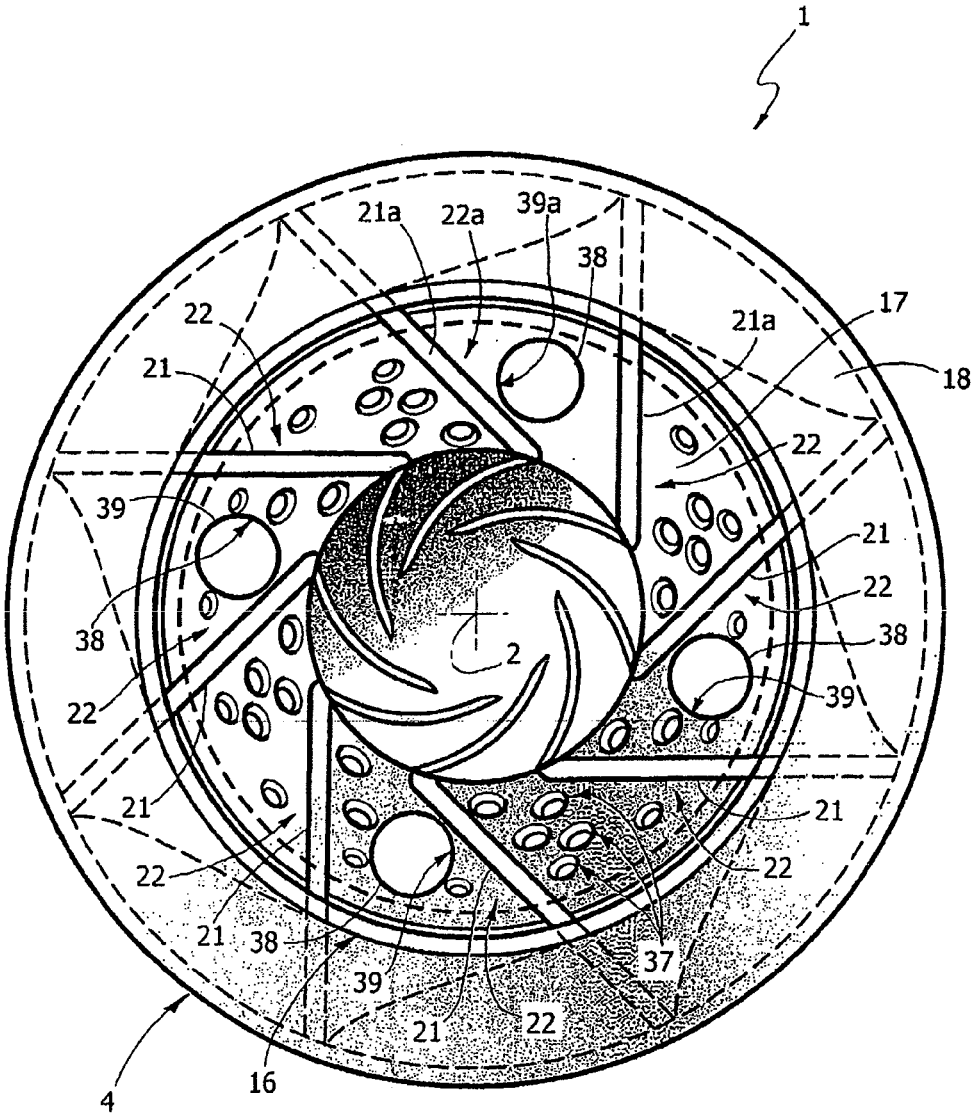
FIG. 2 is a frontal axial view, with parts omitted for clarity and in enlarged scale, of the burner in FIG. 1.

The device 16 comprises an internal cone 17 and an external cone 18, which are partially opposite each other and are reciprocally coupled by a plurality of blades 21 having respective pressure sides and respective depression sides that define in between a series of spaces 22 (FIG. 2).

Figure 3:
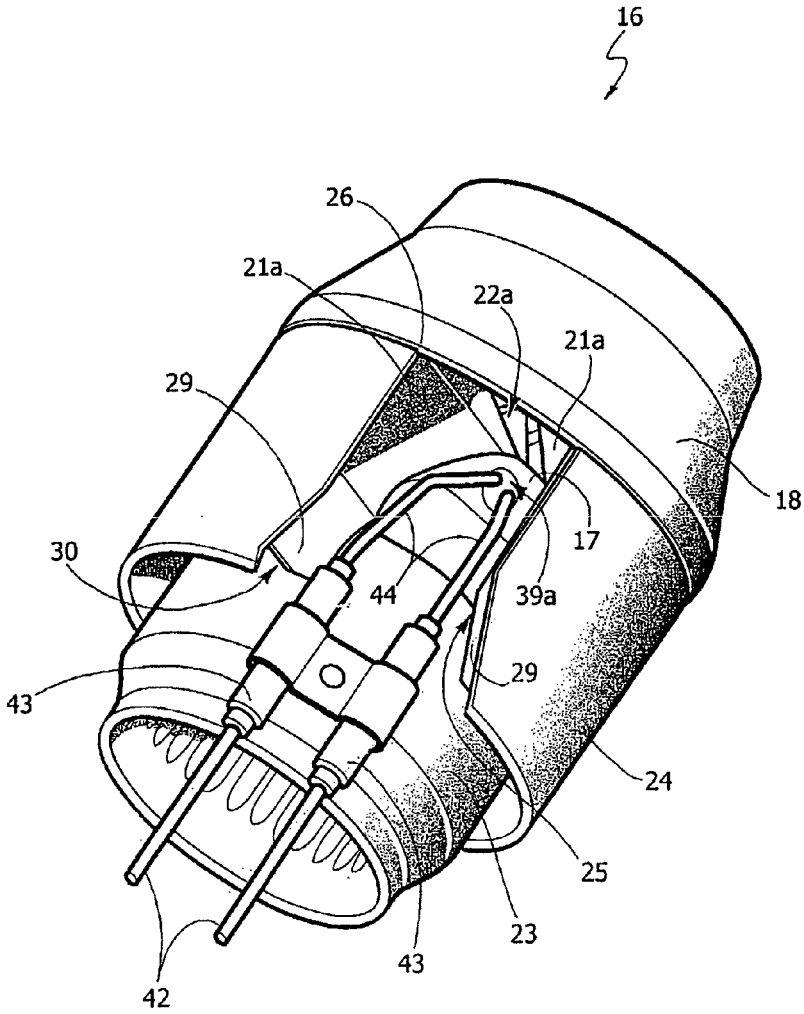
Figure 4A:
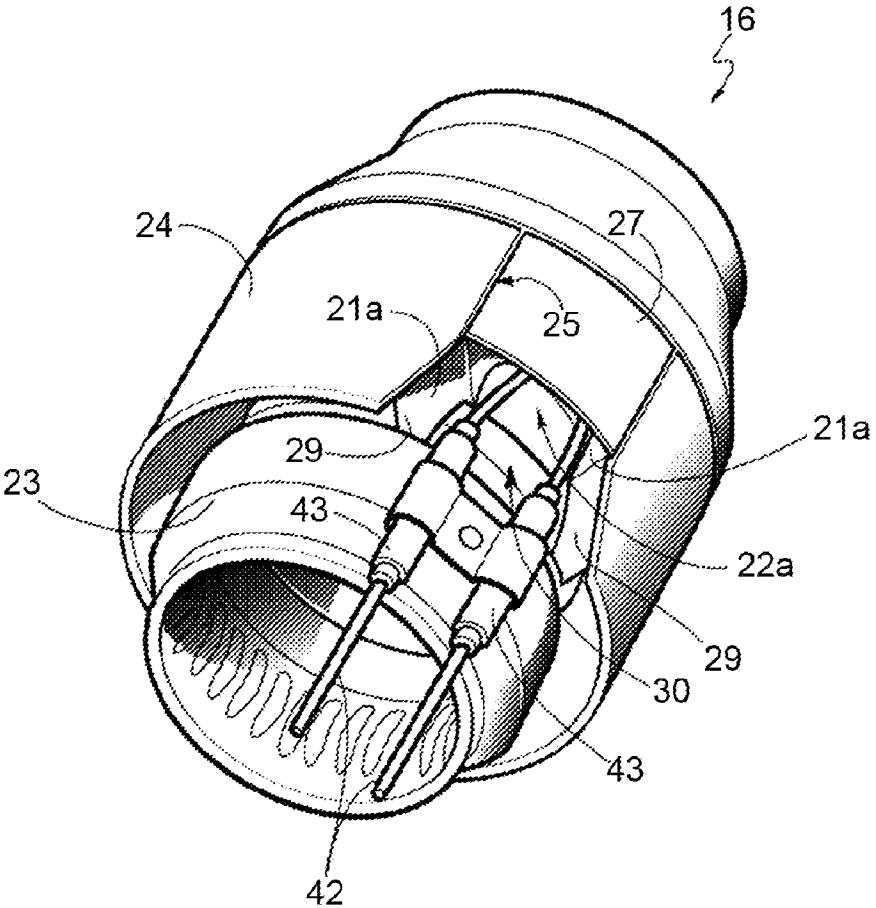
Figure 4B:
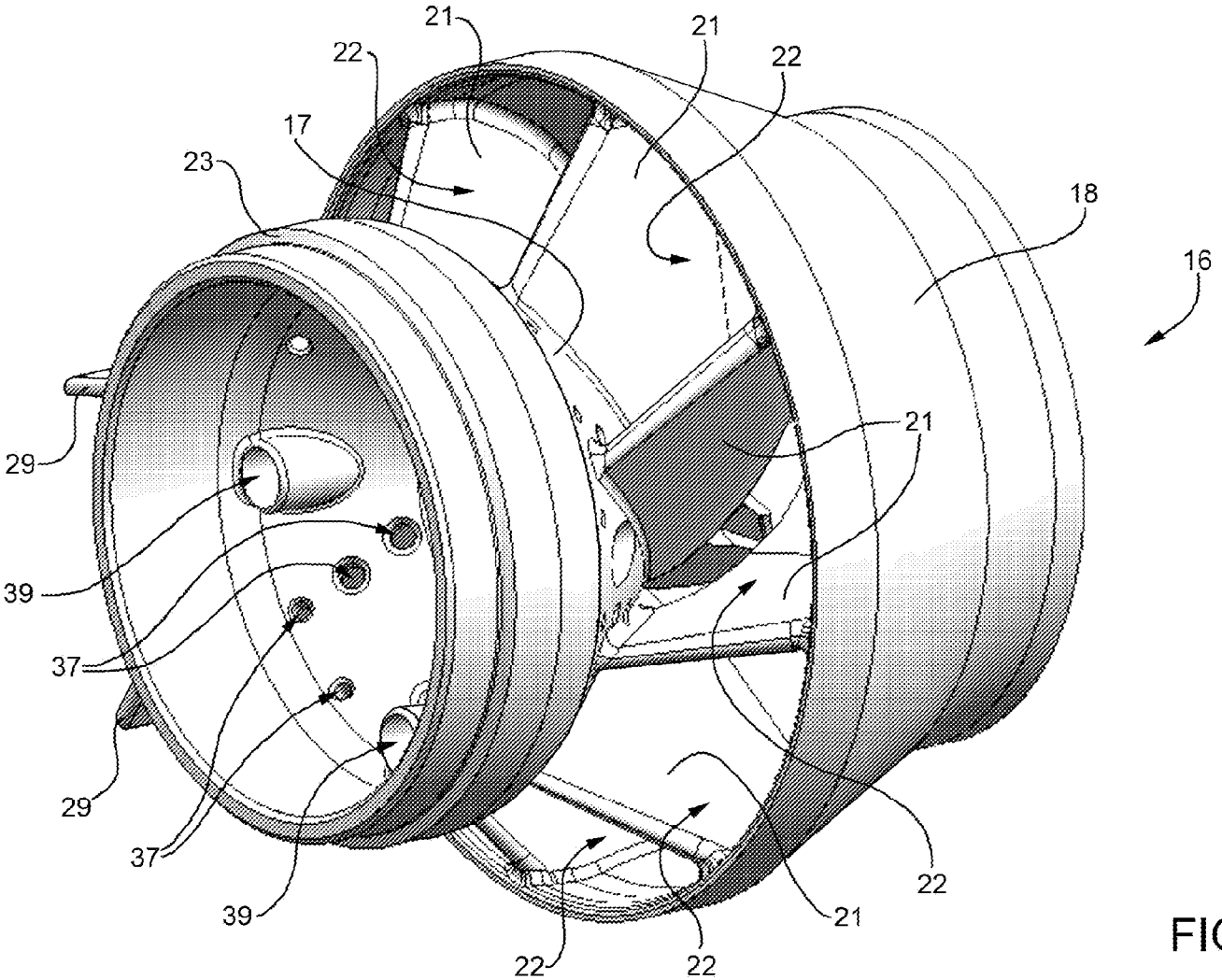
FIG. 4B shows part of the invention with regular length blades, that are all blades except the two shown in FIG. 4C.
Figure 4C:
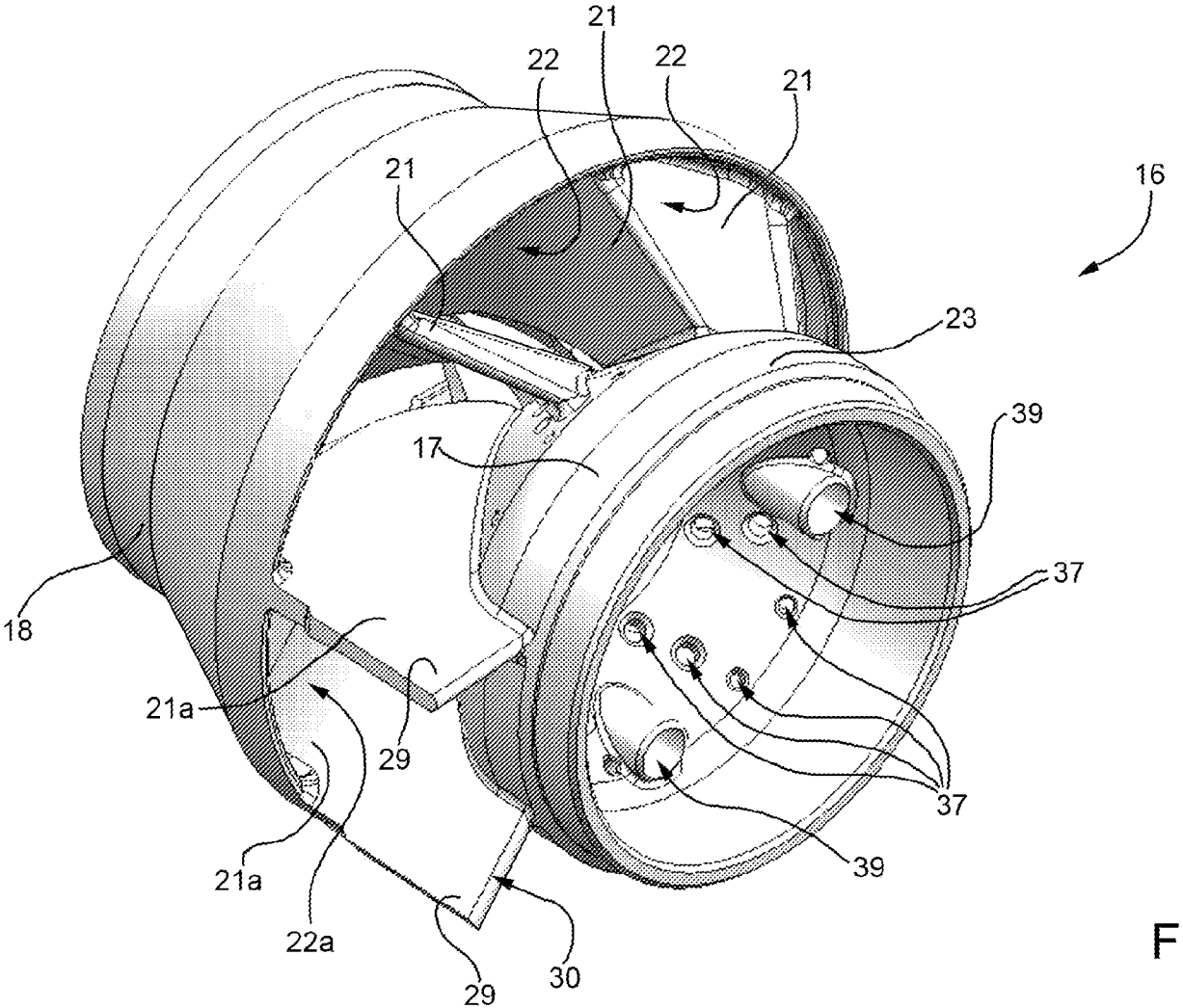
FIG. 4C shows part of the invention with the two elongated blades, that are not shown in FIG. 4B.

With reference to FIGS. 3 and 4A, the device 16, at the rear where the primary air comes from, comprises two coaxial walls 23, 24, which are substantially cylindrical, and extend as an axial extension of the cones 17 and 18 and are respectively fixed to the cones 17, 18 themselves in a manner not described in detail, and are partially opposed to each other in a radial direction. The wall 24 comprises a slit 25 arranged at one of the spaces of the device 16, indicated by the reference numeral 22*a*. An intermediate portion 26 of the space 22*a* is radially outwardly closed by a wall 27 (FIG. 4A), which is fixed watertight to the edges of the slit 25 and to the cone 18 and extends axially for a lesser cut of the wall 24, with respect to the cone 18, that is, it is not flush with the rear edge of the wall 24 directed towards the primary air inlet of device 16.

The space 22*a* in a circumferential direction is defined by two blades 21*a* having axial length greater than the other blades 21 of the device 16. In particular, the blades 21*a* extend between the wall 23 and the edges of the slit 25 and comprise respective end portions 29 which protrude axially with respect to the other blades 21, towards the primary air inlet of the device 16, converge on each other in the direction of the flow of primary air, and form an intake 30 which is adjacent to the portions 26 and is not covered or defined by the wall 27.

Still with reference to FIG. 1, the burner 4 comprises a tubular axial body 34, which fits into a diesel or fuel oil burner 35, which extends axially from the centre of the cone 17 towards the space 3.

The body 34 and the burner 35 together radially define a duct 36, which defines what is known as a "secondary diffusion line" to feed a flow of fuel gas which generates a diffusion flame in the chamber 3.

With reference to FIG. 2, the duct 36 comes out into the spaces 22 through a plurality of holes 37 made in the cone 17 and houses, in a manner not illustrated, four pipes 38, which are isolated from the gas flowing into the duct 36, are parallel to the axis 2, and define what is known as the "pilot line" which comes out into the spaces 22 through respective outlets 39, to feed in fuel gas in particular operating conditions of the turbine, such as a drop in the electrical load applied to the electric machine.

With reference to FIG. 1, the primary comburent air flowing into the spaces 22 comes from an annular duct 40, which is defined, upstream by the device 16, by the body 34 and by a tubular coaxial body 41, and houses an electric line 42, of known type and not described in detail (FIGS. 3 and 4A), provided with a pair of electrodes 43 fixed on the portion 23 and having respective ends 44 arranged in the portions 26 of the space 22*a*, facing one of the outlets of the pipes 38, indicated by reference numeral 39*a*, to fire an ignition spark.

According to the present invention, the ignition of the assembly 1 is effected by firing the spark and directing towards said spark a fuel gas known as synthesis gas, or "syngas" while the turbine operates loadlessly, that is without being connected to the electric machine.

In particular, during the ignition step, the synthesis gas is fed to the pipes 38, that is through the pilot line. Preferably, the space 22*a* in which the ignition spark is fired has only one outlet 39*a*, while being free from the holes 37 (FIG. 2), so as to optimise the fluid mechanical conditions in the space 22*a* itself.

Once the turbine has reached a predetermined number of revolutions, the supply of syngas is commutated from the pilot line to the secondary diffusion line (duct 36). The speed of rotation of the turbine is then increased to reach a full speed and loadless condition. At this point, synchronisation occurs, that is the coupling between the turbine and the electric machine, in particular at a speed of about 3000 rpm but with zero electric charge applied to the electric machine, so as to only allow it to coast.

The electrical load is then increased to a reference value, in particular to up to 50% of the basic load of the electric machine, while continuing to feed syngas from the secondary diffusion line.

Finally, the supply of synthesis gas is gradually commutated from the secondary diffusion line to the primary diffusion line, so as to reach the basic load of the electric machine.

From the above description it is clear how it is possible to operate the gas turbine from the ignition of the assembly 1 to the basic load of the electrical machine, feeding to the assembly 1 fuel gas which is exclusively synthesis and not natural gas, after gauging the passage sections of syngas in the secondary diffusion line and the pilot line so as to reach sufficient flow rates of fuel for correct functioning according to the calorific value of the syngas.

Consequently, the electrical power production plant is simplified and costs are reduced, thanks to the elimination of the supply lines and supply contracts for natural gas.

The constructional and fluid mechanical characteristics of the device 16 allow to avoid flashback and overheating in all operational conditions.

In particular, during ignition, the blades 21*a* of the space 22*a*, thanks to the absence of the holes 37 and the length of said blades, guide the comburent air in an optimal manner and, moreover, accelerate the flow of air towards the spark fired by the electrodes, providing an invitation in the intake portion 30. Moreover, the cut of the wall 26 forms a suitable compromise between the need for a high flow rate of incoming air to the space 22*a* and the need to avoid dispersing the gas flowing from the outlet 39*a*.

The method of the present invention may be easily carried out in existing gas turbines, preferably by replacing the existing axial swirler with the device 16 described above and correctly gauging the sections for the passage of the syngas in the secondary diffusion line and the pilot line.

From the above description, finally, it is clear that modifications and variations to the method described with reference to the accompanying drawings can be effected without leaving the scope of protection of the present invention.

In particular, the ignition could occur by directing syngas towards the spark from an outlet other than the one indicated by way of example.

The invention claimed is:

1. An axial swirler for a burner of a gas turbine, the swirler comprising:

a plurality of blades defining a plurality of blade-to-blade spaces to generate turbulence in a flow of comburent air, said blade-to-blade spaces comprising an ignition space in which an ignition spark is fired by an ingniter; said plurality of blades comprising a first blade group having two blades and a second blade group comprising two or more blades;

first outlets of a secondary diffusion line for supplying fuel gas; and second outlets of a pilot line for supplying fuel gas, wherein said ignition space, in a circumferential direction, is defined by the two blades of the first blade group each having axial dimensions greater than the two or more blades of the second blade group.

2. An axial swirler according to claim 1, wherein the blades defining said ignition space comprise respective portions converging in a direction of the flow of the comburent air.

3. An axial swirler according to claim 2, wherein said converging portions define, in said ignition space, an intake zone for the comburent air.

4. An axial swirler according to claim 3, wherein said ignition space comprises an intermediate portion adjacent to said intake zone and radially outwardly defined by a wall, said intake zone being free from said wall.

5. An axial swirler according to claim 1, wherein said ignition space has a sole outlet among said first and second outlets.

6. An axial swirler according to claim 5, wherein said sole outlet is part of said second outlets.

* * * * *